US008295735B2

(12) United States Patent
Funahashi

(10) Patent No.: US 8,295,735 B2
(45) Date of Patent: Oct. 23, 2012

(54) IMAGE FORMING APPARATUS

(75) Inventor: Norimichi Funahashi, Nissin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 609 days.

(21) Appl. No.: 12/392,165

(22) Filed: Feb. 25, 2009

(65) Prior Publication Data

US 2009/0220278 A1 Sep. 3, 2009

(30) Foreign Application Priority Data

Feb. 29, 2008 (JP) ..... 2008-049518

(51) Int. Cl.
*G03G 15/00* (2006.01)

(52) U.S. Cl. ..... 399/167; 399/51; 399/299; 399/301

(58) Field of Classification Search ..... 399/167, 399/298, 299, 301, 302, 303, 394, 395, 396, 399/51
See application file for complete search history.

(56) References Cited

U.S. PATENT DOCUMENTS

| | | | | |
|---|---|---|---|---|
| 5,444,525 | A | 8/1995 | Takahashi et al. | |
| 5,995,802 | A | 11/1999 | Mori et al. | |
| 6,404,449 | B1 | 6/2002 | Izumiya | |
| 6,771,919 | B2 * | 8/2004 | Koide | 399/167 |
| 7,221,893 | B2 * | 5/2007 | Nishikawa | 399/301 |
| 2003/0138268 | A1 | 7/2003 | Nomura | |
| 2004/0131386 | A1 | 7/2004 | Koide | |

FOREIGN PATENT DOCUMENTS

| | | | |
|---|---|---|---|
| EP | 0616266 | A2 | 9/1994 |
| EP | 0818917 | A2 | 1/1998 |
| JP | 6-315297 | A | 11/1994 |
| JP | 07-225544 | | 8/1995 |
| JP | 7-261499 | A | 10/1995 |
| JP | 9-185192 | A | 7/1997 |
| JP | 2001-088347 | | 4/2001 |
| JP | 2001-337504 | A | 12/2001 |
| JP | 2002-072611 | | 3/2002 |
| JP | 2002-372897 | A | 12/2002 |

(Continued)

OTHER PUBLICATIONS

Notification of First Office Action dated Sep. 27, 2010 in Chinese Application No. 200910119128.9 and English translation thereof.

(Continued)

*Primary Examiner* — Hoang Ngo
(74) *Attorney, Agent, or Firm* — Banner & Witcoff, Ltd.

(57) ABSTRACT

An image forming apparatus includes: a plurality of photosensitive bodies disposed along a moving direction of a recording medium; a drive mechanism for driving and rotating the plurality of photosensitive bodies; a plurality of exposure units, each exposure unit being associated with a respective one of the photosensitive bodies, the each exposure unit configured to expose the respective photosensitive body; a determining unit for determining an exposure-starting phase that is a rotation phase at an exposure-starting timing with respect to one photosensitive body among the plurality of photosensitive bodies; and a varying unit for varying a exposure-starting time difference between the exposure-starting timing of the one photosensitive body and an exposure-starting timing of an other photosensitive body disposed at a downstream side of the one photosensitive body in the moving direction of the recording medium, based on the exposure-starting phase.

10 Claims, 8 Drawing Sheets

FOREIGN PATENT DOCUMENTS

| | | | |
|---|---|---|---|
| JP | 2003-035974 | A | 2/2003 |
| JP | 2003-167207 | | 6/2003 |
| JP | 2007-086264 | A | 4/2007 |

OTHER PUBLICATIONS

JP Office Action dtd Apr. 1, 2010, JP Appln. 2008-049518, partial English Translation.

Extended EP Search Report dtd Jun. 21, 2010, EP Appln. 09002206.2.

JP Office Action dtd Jul. 29, 2010, JP Appln. 2008-049518, partial English Translation.

JP Office Action dtd Mar. 24, 2011, JP Appln. 2008-049518, English translation.

JP Office Action dtd Nov. 25, 2010, JP Appln. 2008-049518, English Translation.

JP Office Action dated Oct. 20, 2011, corresponding Application No. 2008-49518; English Translation.

EP Office Action dtaed Aug. 21, 2012 in corresponding EP Application No. 09002206.2.

* cited by examiner

FIG. 6

| DIVISION AREA | CENTRAL ROTATION PHASE | VARYING PARAMETER | ADJACENT DIFFERENCE |
|---|---|---|---|
| 0 | | | 5 |
| | 22.5 | 8 | |
| 45 | | | 8 |
| | 67.5 | 16 | |
| 90 | | | -11 |
| | 112.5 | 5 | |
| 135 | | | -5 |
| | 157.5 | 0 | |
| | | | -8 |
| | 202.5 | -8 | |
| 225 | | | -10 |
| | 247.5 | -18 | |
| 270 | | | 12 |
| | 292.5 | -6 | |
| 315 | | | 9 |
| | 337.5 | 3 | |
| 360 | | | -3 |

FIG. 7

| DIVISION AREA | CENTRAL ROTATION PHASE | VARYING PARAMETER | ADJACENT DIFFERENCE |
|---|---|---|---|
| 0 | | | 5 |
| | 22.5 | 8 | |
| 45 | | | 8 |
| | 67.5 | 16 | |
| 90 | | | -11 |
| | 112.5 | 5 | |
| 135 | | | -5 |
| | 157.5 | 0 | |
| 180 | | | -8 |
| | 202.5 | -8 | |
| 225 | | | -1 |
| | 236.25 | -9 | |
| 247.5 | | | 0 |
| | 258.75 | -9 | |
| 270 | | | 5 |
| | 281.25 | -4 | |
| 292.5 | | | 2 |
| | 303.75 | -2 | |
| 315 | | | 5 |
| | 337.5 | 3 | |
| 360 | | | -3 |

FIG. 8

M, C TABLE

| DIVISION AREA | CENTRAL ROTATION PHASE | VARYING PARAMETER | ADJACENT DIFFERENCE |
|---|---|---|---|
| 0 | | | 5 |
| | 11.25 | 3 | |
| 22.5 | | | 2 |
| | 33.75 | 5 | |
| 45 | | | 3 |
| | 56.25 | 8 | |
| 67.5 | | | 0 |
| | 78.75 | 8 | |
| 90 | | | -5 |
| | 101.25 | 3 | |
| 112.5 | | | -1 |
| | 123.75 | 2 | |
| 135 | | | -1 |
| | 146.25 | 1 | |
| 157.5 | | | -2 |
| | 168.75 | -1 | |
| 180 | | | -2 |
| | 191.25 | -3 | |
| 202.5 | | | -2 |
| | 213.75 | -5 | |
| 225 | | | -3 |
| | 236.25 | -8 | |
| 247.5 | | | -2 |
| | 258.75 | -10 | |
| 270 | | | 7 |
| | 281.25 | -3 | |
| 292.5 | | | 5 |
| | 303.75 | -3 | |
| 315 | | | 5 |
| | 326.25 | 1 | |
| 337.5 | | | 5 |
| | 348.75 | 2 | |
| 360 | | | |

IMAGE FORMING APPARATUS

CROSS REFERENCE TO RELATED APPLICATION

The present application claims priority from Japanese Patent Application No. 2008-049518, which was filed on Feb. 29, 2008, the disclosure of which is herein incorporated by reference in its entirety.

TECHNICAL FIELD

Apparatuses consistent with the present invention relate to an image forming apparatus for an electro-photography system.

BACKGROUND

Japanese unexamined patent application publication No. JP-A-H07-225544 (Patent Document 1) describes a related art image forming apparatus. In the related art image forming apparatus for an electro-photography system, there is an image forming apparatus in which a tandem system is adopted. In the tandem type image forming apparatus, a plurality of photosensitive bodies corresponding to respective colors are arranged along a moving direction of a recording medium. When forming an image, an electrostatic latent image is formed on a photosensitive body, which is driven and rotated, by exposing the photosensitive body to light by exposing means and a visible image is obtained by developing the corresponding electrostatic latent image, onto the recording medium. The above described operations are carried out in the order from an upstream side photosensitive body, thereby forming a color image (that is, a combined image).

Herein, if the rotating speed of the respective photosensitive bodies is constant at all times, it is possible to form a color image, in which line spacing of the respective color images is even, on the recording medium, by executing exposure of respective lines based on image data at a fixed time interval one after another. However, since the rotating speed of the photosensitive body actually fluctuates cyclically, an abnormal color image in which line spacing of respective color images is uneven sometimes maybe formed, and the image quality is adversely influenced.

Therefore, in the related art image forming apparatus, there is an image forming apparatus that is configured to prevent unevenness in line spacing resulting from fluctuations of the rotating speed of photosensitive bodies (Refer to Patent Document 1).

SUMMARY

However, even if the related art image forming apparatus can prevent unevenness in line spacing of respective color images, a color image having a sufficient quality cannot be necessarily obtained. Since the fluctuation characteristics of the rotating speed differ from each other in respective photosensitive bodies, the time required for the lead line formed on the respective photosensitive bodies to move from the exposure position to the transfer position will change by a rotation phase on which the lead line is formed. As a result, the position where the lead line is formed by the upstream side photosensitive body and the position where the lead line is formed by the downstream side photosensitive bodies are made uneven, therefore, a color gap occurs.

Accordingly, it is an aspect of the present invention to provide an image forming apparatus capable of preventing unevenness in the positions where the lead lines are formed by the respective photosensitive bodies.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an illustrative aspect of the present invention, there is provided an image forming apparatus comprising: a plurality of photosensitive bodies disposed along a moving direction of a recording medium; a drive mechanism for driving and rotating the plurality of photosensitive bodies; a plurality of exposure units, each exposure unit being associated with a respective one of the photosensitive bodies, the each exposure unit configured to expose the respective photosensitive body; a determining unit for determining an exposure-starting phase that is a rotation phase at an exposure-starting timing with respect to one photosensitive body among the plurality of photosensitive bodies; and a varying unit for varying a exposure-starting time difference between the exposure-starting timing of the one photosensitive body and an exposure-starting timing of an other photosensitive body disposed at a downstream side of the one photosensitive body in the moving direction of the recording medium, based on the exposure-starting phase.

According to the present invention, if the rotation phase at the exposure-starting timing of the upstream one photosensitive body (exposure-starting phase) is determined, the time between exposure and transfer of the lead line for the one photosensitive body (that is, the time required for the photosensitive body to rotate from the exposure position to the transfer position) is determined based on the fluctuation characteristics of the rotating speed of the-one photosensitive body. Further, the time between exposure and transfer of the lead lines for the other photosensitive bodies is determined based on the fluctuation characteristics of the rotating speed of the downstream other photosensitive bodies. And, the difference in the exposure-starting time (difference in time between the exposure-starting timing of the-one photosensitive body and the exposure-starting timing of the other photosensitive bodies) is determined based on the time between exposure and transfer of the-one photosensitive body and the other photosensitive bodies and the moving time required for the medium to move from the transfer position of the-one photosensitive body to the transfer position of the other photosensitive bodies, so that a gap between the forming position of the lead line of the-one photosensitive body and the forming position of the lead lines of the other photosensitive bodies can be prevented. Therefore, with the present invention, it was devised that the difference in exposure-starting time could be varied according to the exposure-starting phase. According to such a configuration, it is possible to prevent unevenness in the forming positions of the lead lines from the respective photosensitive bodies.

According to the present invention, it is possible to prevent unevenness in the forming positions of the lead lines from respective photosensitive bodies.

BRIEF DESCRIPTION OF THE DRAWINGS

Illustrative aspects of the invention will be described in detail with reference to the following figures wherein:

FIG. 6 is a view showing a data structure of a corresponding relationship between respective division areas, central rotation phases, and varying parameters;

FIG. 7 is a view (Part 1) showing a data structure of a corresponding relationship between respective division areas, central rotation phases, and varying parameters according to a modified version; and FIG. 8 is a view (Part 2) showing a data structure of a corresponding relationship between respective division areas, central rotation phases, and varying parameters according to a modified version.

DETAILED DESCRIPTION OF EXEMPLARY EMBODIMENTS OF THE PRESENT INVENTION

A description is given of one exemplary embodiment of the present invention with reference to FIG. 1 through FIG. 6.

1. Configuration of Printer

Figure 1:
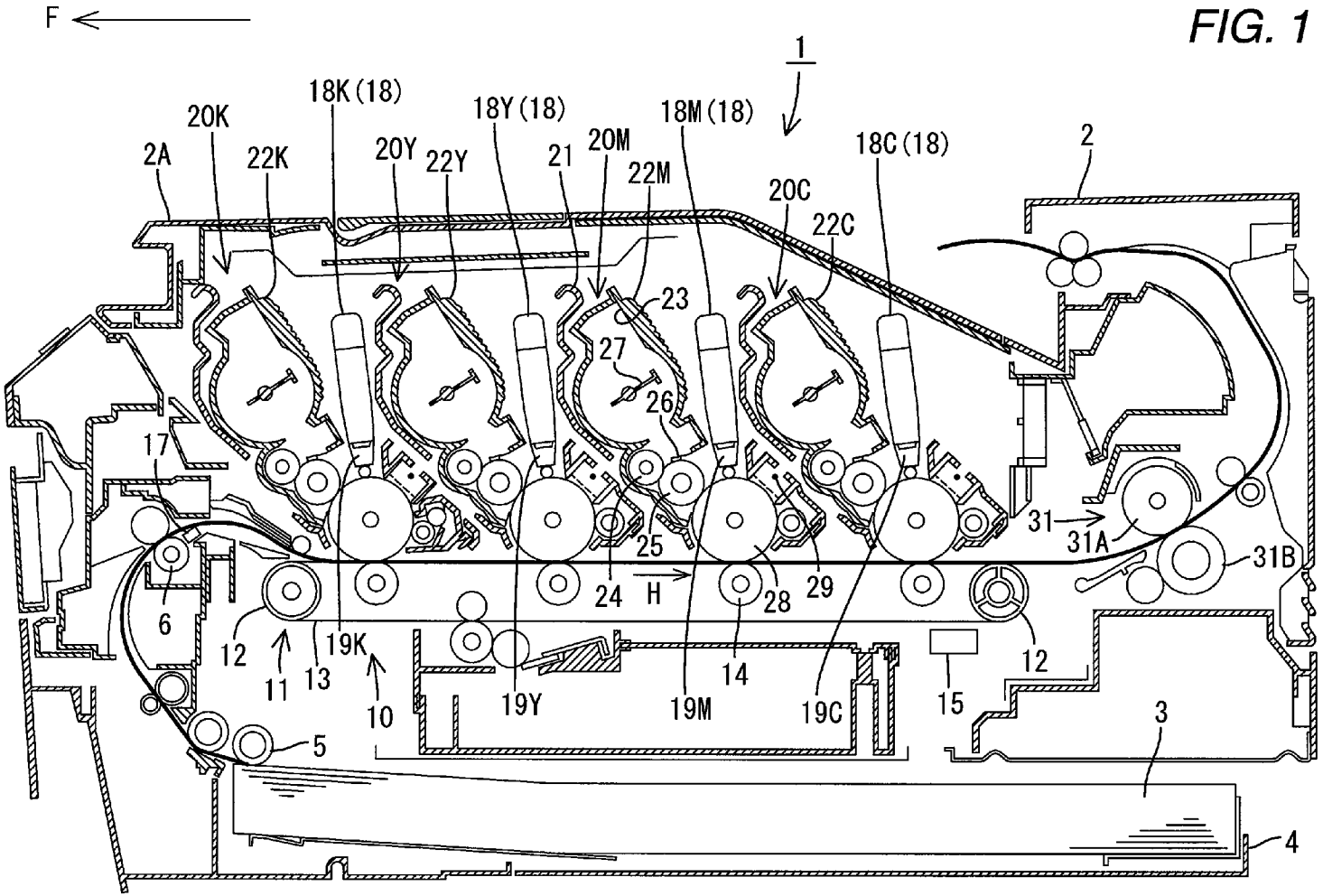
FIG. 1 is a side sectional view showing a printer according to one exemplary embodiment of the present invention.
Figure 2:
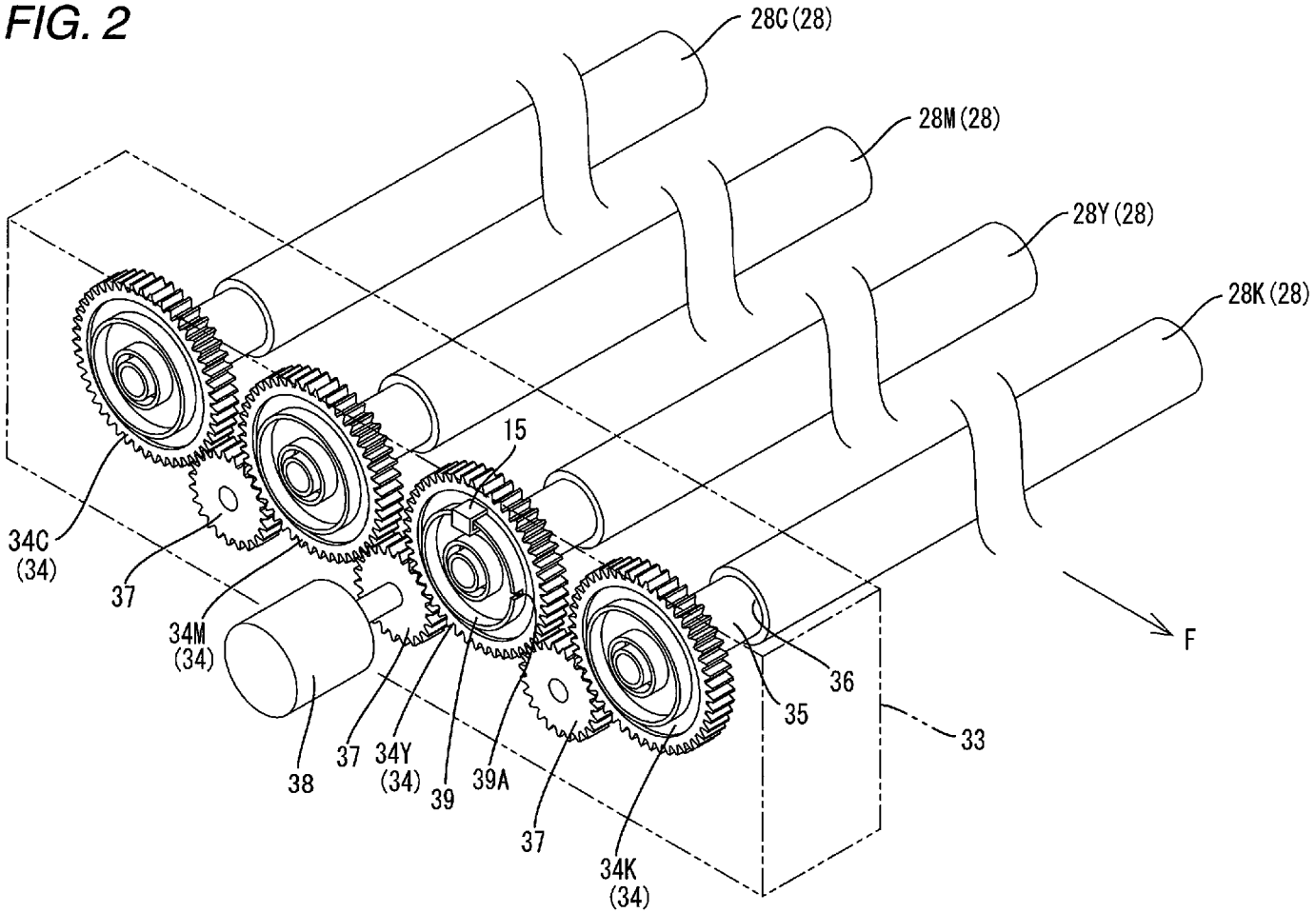
FIG. 2 is a perspective view showing a simplified drive mechanism.

FIG. 1 and FIG. 2 are side sectional views showing a brief configuration of a printer 1 (one example of an image forming apparatus) according to the embodiment. Also, in the following description, the left direction of the paper of FIG. 1 and FIG. 2 is the forward direction of the printer, which is shown as the F direction in the respective drawings. Also, the printer 1 is a printer for forming a color image by using four color toners (black K, yellow Y, magenta M and cyan C). In the following description, where respective components are classified color by color, K (black), Y (yellow), M (magenta) and C (cyan) are added to the end of the reference numeral of the respective components.

The printer 1 is provided with a body casing 2. A feeder tray 4 on which sheets 3 (one example of a recoding medium) are stacked is provided on the bottom portion of the body casing 2. A feeder roller 5 is provided above the front end of the feeder tray 4, a sheet 3 stacked on the uppermost layer in the feeder tray 4 is sent out to a registration roller 6 in conjunction with rotations of the feeder roller 5. The registration roller 6 conveys a sheet 3 onto a belt unit 11 of an image forming unit 10 after correcting biasing of the sheet 3.

The image forming unit 10 includes a belt unit 11, an exposure unit 18, a processing unit 20 and a fixing unit 31, etc.

The belt unit 11 is configured so as to have an annular belt 13 suspended between a pair of front and rear belt supporting rollers 12. And, since the rear side belt supporting roller 12 is driven and rotated, the belt 13 is circulated and moved in the clockwise direction shown in the drawing, and a sheet 3 on the upper surface of the belt 13 is conveyed backward (one example of the conveyance direction of a recording medium, hereinafter called a "sheet conveyance direction H"). Also, a transfer roller 14 is provided inside the belt 13 at a position facing the respective photosensitive bodies of the processing units 20 described later with the belt 13 placed therebetween. In addition, in the following description, where only [the upstream side or the downstream side] is referred to with any detailed direction referred to, the upstream side means the upstream side in the sheet conveyance direction H, and the downstream side means the downstream side in the same direction.

The exposure unit 18 is provided with four LED units 18K, 18Y, 18M and 18C (one example of the exposing means) corresponding to the respective colors of black, yellow, magenta and cyan. The respective LED units 18 include LED heads 19K, 19Y, 19M and 19C at the lower end parts thereof. The LED heads 19K, 19Y, 19M and 19C are a plurality of LEDs which are arranged in one line in the left and right directions. The respective LEDs are controlled with respect to light emission based on image data to be formed, and light emitted from the respective LEDs is irradiated onto the surface of the photosensitive bodies 28 to expose the surface.

The processing unit 20 is provided with four process cartridges 20K, 20Y, 20M and 20C corresponding to the four colors. The respective process cartridges 20K, 20Y, 20M and 20C are provided with a cartridge frame 21 and development cartridges 22K, 22Y, 22M and 22C detachably mounted on the cartridge frame 21. In addition, in the exemplary embodiment, four sets of forming means are configured by the LED units 18K, 18Y, 18M and 18C, the process cartridges 20K, 20Y, 20M and 20C, and the respective transfer rollers 14.

The respective development cartridges 22 are provided with toner accommodation chambers 23 for accommodating respective colors of toners being a developer, and are further provided with a supply roller 24, a development roller 25, a layer thickness regulation blade 26 and an agitator 27, etc., at the underneath thereof. Toner discharged from the toner accommodation chamber 23 is supplied to the development roller 25 by rotations of the supply roller 24, and is friction-electrified between the supply roller 24 and the development roller 25. Further, the toner supplied onto the development roller 25 enters between the layer thickness regulation blade 26 and the development roller 25 in conjunction with rotations of the development roller 25, wherein the toner is further friction-electrified and is carried on the development roller 25 as a thin layer of a fixed thickness.

A photosensitive body 28 the surface of which is covered with a positively electrified photosensitive layer and a scorotron type electrifier 29 are provided at the lower part of the cartridge frame 21. When forming an image, the photosensitive body 28 is driven and rotated, and the surface of the photosensitive body 28 is uniformly positively electrified in conjunction therewith. And, the positively electrified portion is exposed by light from the exposure unit 18, and an electrostatic latent image corresponding to an image to be formed on a sheet 3 is formed on the surface of the photosensitive body 28.

Next, positively electrified toner carried on the development roller 25 is supplied to an electrostatic latent image formed on the surface of the photosensitive body 28 when facing and brought into contact with the photosensitive body 28 by rotations of the development roller 25. Therefore, the electrostatic latent image of the photosensitive body 28 is made visible, and a toner image having toner adhered only to the exposed portion is carried on the surface of the photosensitive body 28.

After that, a toner image carried on the surface of the respective photosensitive bodies 28 is transferred to a sheet 3 conveyed by the belt 13 one after another by transfer voltage of negative polarity, which is applied to the transfer roller 14, while the sheet 3 passes through the respective transfer positions between the photosensitive bodies 28 and the transfer rollers 14. Thus, the sheet 3 having the toner image transferred thereon is next conveyed to a fixing unit 31.

The fixing unit 31 is provided with a heating roller 31A having a heating source and a compression roller 31B for pressing the sheet 3 to the heating roller 31A side. The toner image transferred on the sheet 3 is thermally fixed on the sheet surface. And, the sheet 3 thermally fixed by the fixing unit 31 is conveyed upward and is discharged onto the upper surface of the body casing 2.

2. Drive Mechanism of Photosensitive Body

FIG. 2 is a perspective view showing a simplified drive mechanism 33 for driving and rotating the photosensitive body 28. The drive mechanism 33 is disposed at one end side of the four photosensitive bodies 28. The drive mechanism 33 includes four drive gears 34 (34K, 34Y, 34M and 34C) corresponding to the respective photosensitive bodies 28. The respective drive gears 34 are rotatably provided coaxially with the photosensitive body 28 corresponding thereto, and are linked with the respective photosensitive bodies 28 by a coupling mechanism. In detail, the respective drive gears 34 have a fitting portion 35 protruded and formed coaxially therewith, and the fitting portion 35 is fitted to a recess 36 formed at the end part of the photosensitive body 28, wherein the photosensitive body 28 is rotated integrally with the drive gear 34 by its drive and rotation. In addition, the respective fitting portions 35 are made movable between the fitting position shown in FIG. 2 and the spaced position spaced from the photosensitive body 28. For example, when the processing unit 20 is replaced, the processing unit 20 can be removed from the body casing 2 by causing the fitting portion 35 to move to the spaced position.

The drive gears 34 adjacent to each other are gear-linked with each other via an intermediate gear 37. In the exemplary embodiment, a drive force is given to an intermediate gear 37 (the intermediate gear for linking the drive gear 34Y with the drive gear 34M) positioned at the central position by a drive motor 38 (one example of the drive source). Therefore, four drive gears 34 and four photosensitive bodies 28 are rotated altogether.

In addition, an origin sensor 15 (one example of reference rotation phase sensor) is provided at one drive gear 34 (in the present embodiment, the drive gear 34Y). The origin sensor 15 is a sensor that detects whether or not the rotation phase (rotation angle) of the drive gear 34K reaches a predetermined origin phase B0 as described later.

In detail, a circular rib portion 39 centering around the rotation axis is provided at the drive gear 34Y, and a slit 39A is formed at one point thereof. The origin sensor 15 is a transmission type optical sensor having a light emitting element and a light receiving element, facing via the rib portion 39. When a portion other than the slit 39A is located at the detection area of the origin sensor 15, light from the light emitting element is blocked by the rib portion 39, wherein the light receiving amount level of the light receiving element is made comparatively low. On the other hand, when the slit 39A is located in the detection area (the rotation phase of the drive gear 34Y reaches the origin phase B0), the light from the light emitting element is not blocked, wherein the light receiving amount level of the light receiving element is made higher. In the exemplary embodiment, it is designed that the photosensitive body 28 is brought into the origin phase described later when the origin sensor 15 is brought into a light-receiving state. Therefore, the CPU 40 described later receives a detection signal SA corresponding to a change in the light receiving amount level from the origin sensor 15, the timing is recognized, at which the rotation phase of the drive gear 34K reaches the origin phase (hereinafter called an "origin detection timing").

Also, since the respective drive gears 34 and the photosensitive bodies 28 corresponding thereto are rotated integrally and coaxially with each other, it can be regarded that the rotation phase of the drive gears 34 is approximately coincident with the rotation phase of the photosensitive bodies 28. Therefore, since the origin sensor 15 detects whether or not the drive gear 34 reaches the origin phase B0, the origin sensor 15 indirectly detects whether or not the photosensitive body 28 reaches the origin phase B0. Hereinafter, the drive gear 34 having reached the origin phase B0 and the photosensitive body 28 having reached the origin phase B0 may be used to mean the same thing.

3. Electrical Configuration

Figure 3:
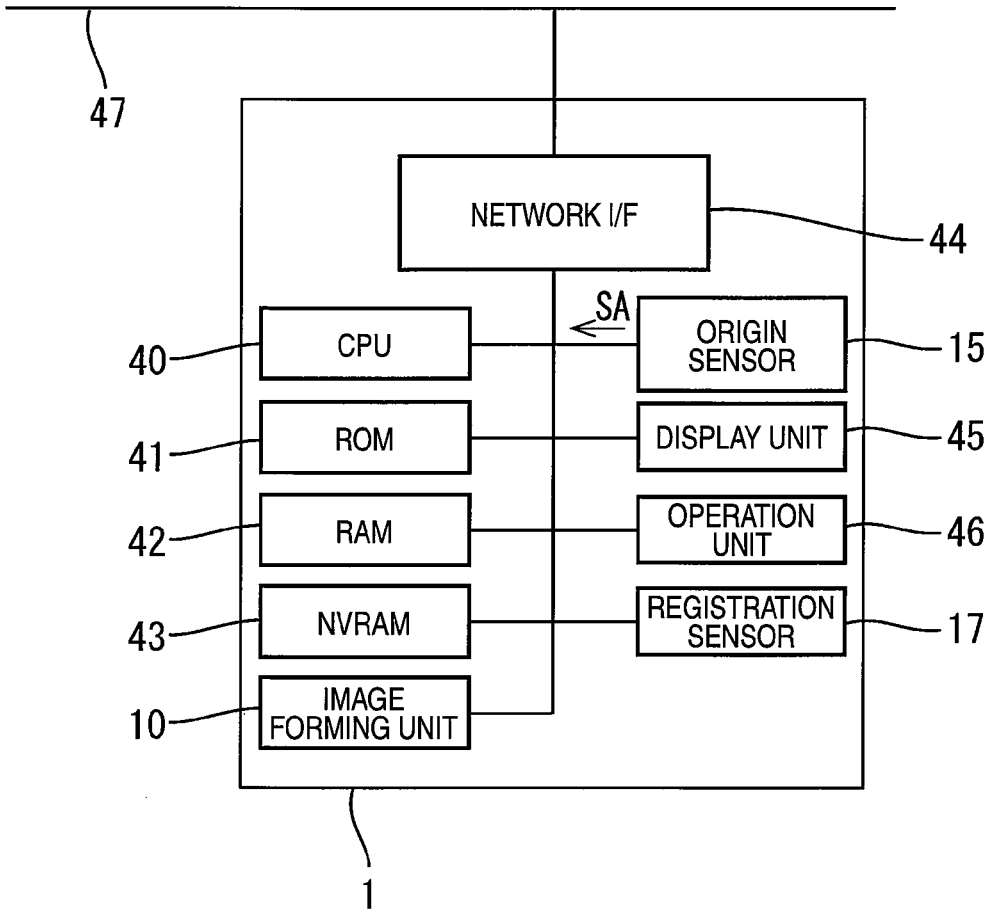
FIG. 3 is a block diagram showing an electrical configuration of the printer.

FIG. 3 is a block diagram showing electrical configuration of the printer 1.

The printer 1 includes, as shown in the same drawing, a CPU 40 (one example of determining means and varying means), a ROM 41, a RAM 42, a NVRAM (non-volatile memory) 43, and a network interface 44. The image forming unit 10, the origin sensor 15, registration sensor 17, display unit 45 and operation unit 46, which were described above, are connected thereto.

Programs are stored in the ROM 41, which executes various types of operations of the printer 1 such as a printing process and a correction process of the lead lines described later. The CPU 40 controls respective units according to the programs read from the ROM 41 while storing the process results in the RAM 42 or the NVRAM 43. The network interface 44 is connected to a peripheral computer (not illustrated) via a communications line 47, and the network interface 44 enables data transmission therebetween. The registration sensor 17 is provided at the downstream side with respect to the registration roller 6 and detects the lead edge of the sheet 3 sent out by the registration roller 6.

4. Forming Position of Lead Line and Difference in Exposure-Starting Time

[Forming position of lead line] means the position on a sheet 3 where the lead line of an image in the sheet conveyance direction H (the sub-scanning direction) is to be transferred from the photosensitive body 28. Also, where color image data corresponding to the lead line are the data showing that the corresponding color image is not formed (transferred) (that is, data showing blank), there may be cases where no image line is transferred on the forming position of the lead line. If the forming position of the lead line of one color image deviates from the forming positions of the lead lines of the other color images, a color image in which a color gap occurred is formed, wherein it is preferable that the gap in the forming positions of the lead lines between color images is minimized.

In a case where the exposure-starting timing of the other photosensitive bodies 28 at the downstream side from one photosensitive body 28 using the exposure-starting timing of the corresponding one photosensitive body 28 as a reference, [Difference ΔT in exposure-starting time] means a difference in time between the exposure-starting timing of the-one photosensitive body 28 and the exposure-starting timing of the other photosensitive bodies 28. The [exposure-starting timing] is timing at which the respective LED units 18 start exposure of the lead line onto the corresponding photosensitive bodies 28. In detail, the timing is timing at which the CPU 40 gives the respective LED units 18 a starting command (vertical synchronization signal VSYNC) of exposure process to the photosensitive body 28.

When the forming position of the lead line of one color image from one photosensitive body 28 is coincident with the forming position of the lead line of the other color image from the other photosensitive body, the regular difference ΔT' in exposure-starting time may be defined as follows.

Difference $\Delta T'$ in exposure-starting time=[Time $T1$ between exposure and transfer of one photosensitive body 28]+[Moving time $T3$ of sheet 3 between transfer positions $Z$ of both photosensitive bodies 28,28]−[Time $T1$ between exposure and transfer of the other photosensitive body 28] Expression 1

[Time 1 between exposure and transfer (T1K, T1Y, T1M and T1C)]: Time which the lead line image exposed on the photosensitive body 28 at the exposure position W (WK, WY, WM, WC) reaches from the exposure position W (Wk, WY, WM and WC) to the transfer position Z (ZK, ZY, ZM and ZC). In addition, the lead line image is developed to be visible images of respective colors from an electrostatic latent image by the development roller 25 within the time between exposure and transfer.

Figure 4:
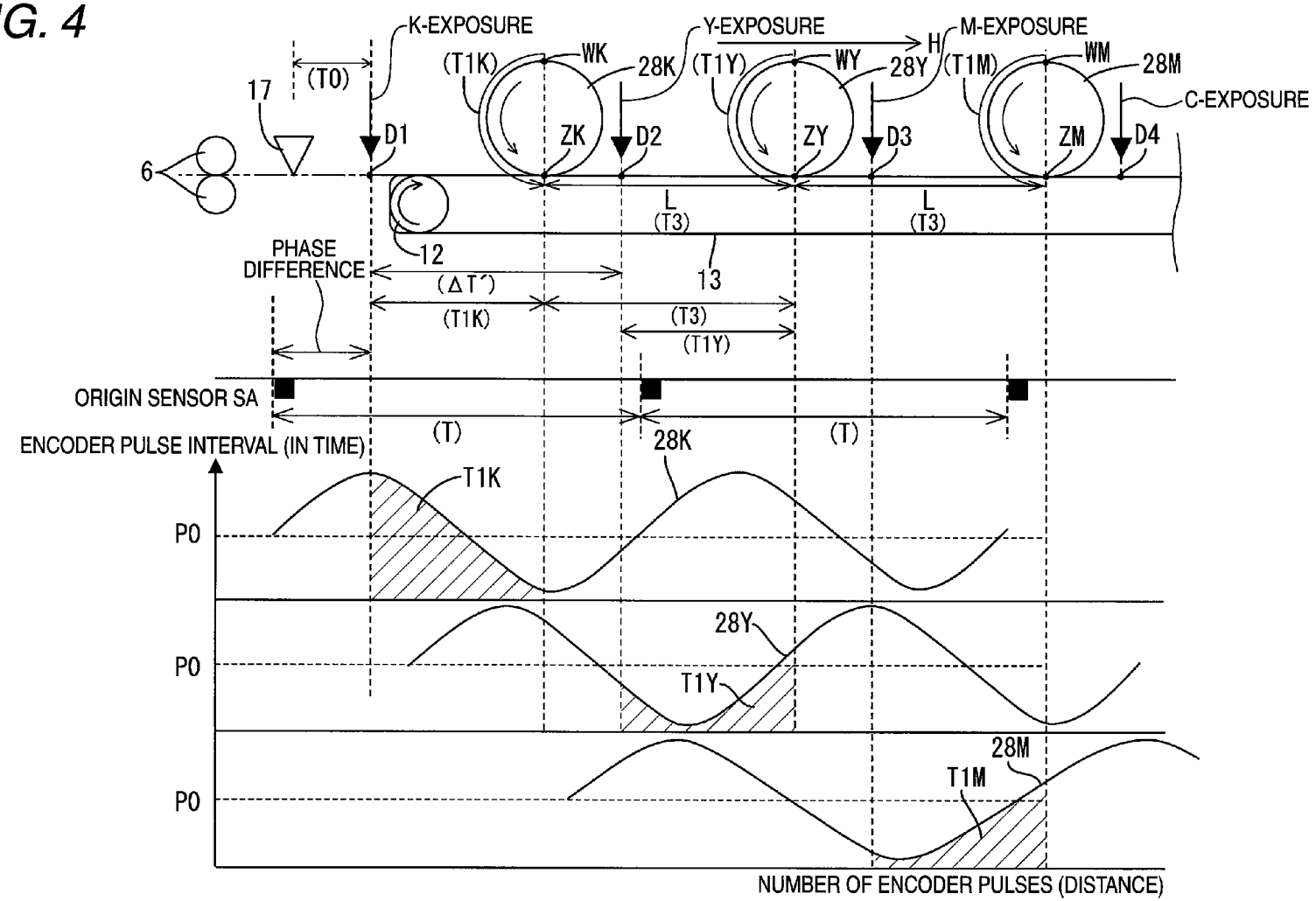
FIG. 4 is a view showing the relationship between a conveyance channel of sheets, origin detection timing of an origin sensor, and fluctuation characteristics of rotating speeds of respective photosensitive bodies.

Hereinafter, a description is given of the basis of Expression 1 with reference to FIG. 4. FIG. 4 is a view showing the relationship between the conveyance path of sheet 3, origin detection timing of the origin sensor 15 and the fluctuation characteristics of the rotating speed of respective photosensitive bodies 28. A schematic view in which the conveyance path of sheet 3 is linearly developed is shown at the uppermost stage of respective drawings. The middle stage thereof shows the origin detection timing (black solid square markings) using the conveyance path length of the upper stage with respect to the origin sensor 15 as a reference. The lower stage thereof shows the fluctuation characteristics graph the rotating speed of a photosensitive body 28 (FIG. 4 shows the photosensitive body 28K, the photosensitive body 28Y, and the photosensitive body 28M) using the conveyance path length of the upper stage as a reference. Also, since the respective drawings are illustrated using the conveyance path length as a reference, information regarding time such as the moving time of sheet 3 in respective conveyance path zones is shown using a bracket.

Hereinafter, the following conditions are premised in order to simplify the description. However, the conditions are not to limit the scope of the present invention.

(A) The four photosensitive bodies 28 have the same diameter in design.

(B) In any one of the photosensitive bodies 28, the position approximately rotated by 180° with respect to the transfer position Z (ZK, ZY, ZM and ZC) is made into the exposure position W (WK, WY, WM and WC) exposed by the LED unit 18.

(C) It is assumed that sheet 3 is moved at a fixed speed (hereinafter called "sheet moving speed VI") between respective transfer positions Z by a belt 13.

(D) The exposure-starting timing of the uppermost stream photosensitive body 28 is predetermined time T0 after the detection timing at which the registration sensor 17 detects the lead edge of the sheet 3.

(E) The distances L between the transfer positions Z adjacent to each other are all the same.

(F) The exposure-starting timing of the remaining photosensitive bodies 28Y, 28M and 28C excluding the uppermost stream photosensitive body 28K is determined based on the exposure-starting timing of the photosensitive body 28K, 28Y or 28M immediately at the upstream side thereof.

For example, as the exposure-starting timing of the photosensitive body 28K arrives, the lead line image of black image is exposed to the photosensitive body 28K at the exposure position WK, and the lead line image of the black image is transferred onto sheet 3 at the transfer position ZK when the time T1K between exposure and transfer of the photosensitive body 28K elapses from the exposure-starting timing. When the moving time T3 of sheet 3 elapses from the transfer timing, the lead line image of the black image on the sheet 3 reaches the transfer position ZY by conveyance of the belt 13.

On the other hand, as the exposure-starting timing of the photosensitive body 28Y arrives, the lead line image of the yellow image is exposed to the photosensitive body 28Y at the exposure position WY, and when the time T1Y between exposure and transfer of the photosensitive body 28Y elapses from the exposure-starting timing, the lead line image of the yellow image is transferred onto sheet 3 at the transfer position ZY.

The forming position of the lead line of the black image is coincident with the forming position of the lead line of the yellow image means that the lead line image of the black image on sheet 3 and the lead line image of the yellow image on the photosensitive body 28Y reach the transfer position ZY at the same time. Therefore, with respect to the point of time when the time T1K between exposure and transfer and the moving time T3 of sheet 3 elapse from the exposure-starting timing of the photosensitive body 28K, the timing earlier by the time T1Y between exposure and transfer of the photosensitive body 28Y may be made into the exposure-starting timing of the photosensitive body 28Y. Accordingly, the above-described expression can be established.

5. Fluctuation in Rotating Speed of Photosensitive Body and Difference ΔT' in Exposure-Starting Time Here, it is assumed that all the photosensitive bodies 28 carry out constant velocity rotation at the same speed respectively. In this case, in all the photosensitive bodies 28, the time T1 between exposure and transfer becomes constant at all times. Therefore, in the above expression 1, the difference between [the time between exposure and transfer of the upstream side photosensitive body 28] and [the time between exposure and transfer of the downstream side photosensitive body 28] becomes zero. As a result, the expression 1 becomes as follows;

Difference $\Delta T'$ in exposure-starting time=[Moving time of sheet 3 between the transfer positions $Z$ of both photosensitive bodies 28] Expression 2

That is, the difference ΔT' in exposure-starting time is determined only by the moving time of sheet 3 between the transfer positions Z of both photosensitive bodies 28, and since, in the present embodiment, the sheet moving speed V1 is constant, the difference ΔT in exposure-starting time can be made into a fixed value.

However, as shown in the lower stage of FIG. 4, etc., actually there is cyclic unevenness in the rotating speed of the photosensitive bodies 28 due to eccentricity of the photosensitive bodies 28 and the drive gears 34. Further, the fluctuation characteristics of the rotating speed differ from each other in the respective photosensitive bodies 28. That is, [time T1 between exposure and transfer of one photosensitive body 28] and [time T1 between exposure and transfer of the other photosensitive bodies 28] in the above expression 1 differ from each other by combinations of the-one photosensitive body 28 and the other photosensitive bodies 28.

In addition, in the exposure-start timing of the-one photosensitive body 28, such a configuration is not provided which synchronizes the drive gears 34 of the drive mechanism 33 so as to be kept in the same rotation phase at all times. Therefore, the rotation phases in the exposure-starting timing with respect to the photosensitive body 28K differ whenever sheet 3 is conveyed onto the belt 13. This is the same as for the other photosensitive bodies 28Y, 28M and 28C. Accordingly, [time T1 between exposure and transfer of one photosensitive body 28] and [time T1 between exposure and transfer of the other photosensitive bodies 28] in the above expression 1 change even if the combinations of the-one photosensitive body 28 and the other photosensitive bodies 28 are the same.

Therefore, in the exemplary embodiment, the difference ΔT' in exposure-starting time is devised to be varied according to ([time T1 between exposure and transfer of one photosensitive body 28]−[time T1 between exposure and transfer of the other photosensitive bodies 28]).

6. Derivation of Varying Parameters

Figure 5:
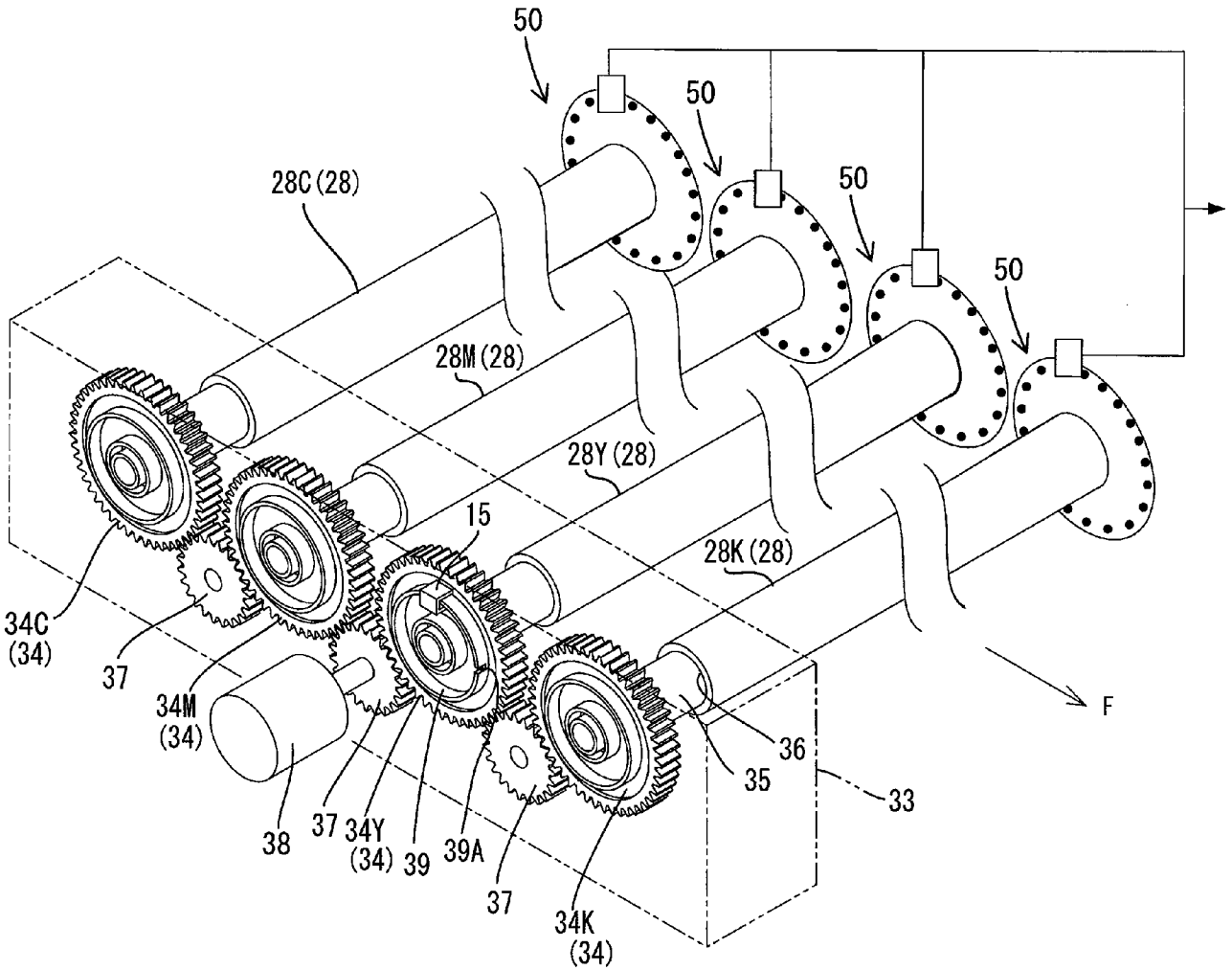
FIG. 5 is a perspective view showing a simplified drive mechanism in a state where a rotary encoder is mounted.

The relationship between origin detection timing of the origin sensor 15 and the fluctuation characteristics of the rotating speed of the respective photosensitive bodies 28 in FIG. 4, etc., can be obtained by, for example, experiments in the production step of the printer 1. In detail, as shown in FIG. 5, a rotary encoder 50 is mounted to one end part of each photosensitive body 28, and the drive mechanism 38 is driven. Encoder pulse signals output from the respective rotary encoders 50 and detection signals SA from the origin sensor 15 are recorded in time series. In the exemplary embodiment, after-shipment printers 1 are not provided with any rotary encoder 50.

In the fluctuation characteristics graph of the rotating speed of respective photosensitive bodies 28, which is shown in FIG. 4, etc., the vertical axis thereof indicates an encoder pulse interval (time) P of the encoder pulse signals, and the horizontal axis thereof indicates the number of the respective encoder pulses using the conveyance path length of the upper stage as a reference. [Reference pulse interval P0] is an encoder pulse interval when the surface velocity of the photosensitive body 28 becomes the same as the above-described sheet moving speed V1. This may be calculated by the following expression 3. Also, in the exemplary embodiment, the origin sensor 15 detects, as the origin phase, the rotation phase of the photosensitive body 28K when the encoder pulse interval P is the reference pulse interval P0.

Reference pulse interval=[One cycle length of photosensitive body 28]/[Sheet moving speed $V1$]/[Number of encoder pulses for one cycle $T$ of photosensitive body 28] Expression 3

When the encoder pulse interval P is larger than the reference pulse interval P0 in the fluctuation characteristics graph, it means that the surface velocity of the photosensitive body 28 is slower than the sheet moving speed V1, and when the encoder pulse interval P is smaller than the reference pulse interval P0 in the fluctuation characteristics graph, it means that the surface velocity of the photosensitive body 28 is faster than the sheet moving speed V1.

As shown in FIG. 4, the time T1 between exposure and transfer of the photosensitive body 28 may be obtained as an accumulated value (the area of the oblique-lined portion of the fluctuation characteristics graph) of all the encoder pulse intervals of the encoder pulses output from the rotary encoder 50 until the lead line image is exposed to the photosensitive body 28 at the exposure position W and the lead line image reaches the transfer position Z. Since the number of encoder pulses (hereinafter called the number of encoder pulses between exposure and transfer) output within the time T1 between exposure and transfer is constant regardless of a difference in the rotation phase of the photosensitive body 28, it is possible to calculate the time T1 between exposure and transfer if the encoder pulse intervals P equivalent to the number of encoder pulses between exposure and transfer are accumulated. In addition, the number of encoder pulses between exposure and transfer may be obtained by the following expression.

Number of encoder pulses between exposure and transfer=[Encoder pulses equivalent to one cycle $T$ of the photosensitive body]*[Cycle length from the exposure position $W$ of the photosensitive body 28 to the transfer position $Z$]/[One cycle length of the photosensitive body 28] Expression 4

And, the time T1 between exposure and transfer of the photosensitive body 28 fluctuates as described above. However, if the rotation phases of the-one photosensitive body 28 and the other photosensitive bodies 28 are found at a predetermined timing before the exposure-starting timing of one photosensitive body 28 after sheet 3 is sent out by the registration roller 6, the above-described [Time T1 between exposure and transfer of one photosensitive body 28] and [Time T1 between exposure and transfer of the other photosensitive bodies 28] are unambiguously determined. In the exemplary embodiment, the exposure-starting phase P1, which is the rotation phase at the exposure-starting timing with respect to the photosensitive body 28K, is determined based on a difference in time between the origin detection timing by the origin sensor 15 and the exposure-starting timing of the photosensitive body 28K. If the exposure-starting phase P1 is determined, the encoder pulses equivalent to the number of encoder pulses between exposure and transfer, which are output within the time T1 between exposure and transfer of the photosensitive body 28K, are unambiguously determined. Therefore, the time T1 between exposure and transfer corresponding to the above-described exposure-starting phase P1 can be calculated.

Also, as described above, the drive mechanism 33 drives and rotates all the photosensitive bodies 28 by a common drive motor 38. Therefore, all the photosensitive bodies 28 have the same cycle per one rotation and the mutual phase relationship thereof does not change. That is, the phases of all the photosensitive bodies 28 hardly deviate with respect to the origin detection timing of the origin sensor 15. Therefore, if the origin sensor 15 is provided with respect to one photosensitive body 28, the exposure-starting phase P1 of the photosensitive body 28K is determined based on the origin detection timing. If the exposure-starting phase P1 is determined, the time T1 between exposure and transfer of not only the photosensitive body 28K but also the other photosensitive bodies 28Y, 28M and 28C are unambiguously determined. Also, in the exemplary embodiment, the origin sensor 15 is provided at the photosensitive body 28Y close to the drive motor 38. The further the photosensitive body 28 is apart from the drive motor 38, the greater the fluctuation in the rotating speed increases. Therefore, it is preferable that the origin sensor 15 is provided at the photosensitive body 28 close to the drive motor 38.

In the exemplary embodiment, information regarding the corresponding relationship between the rotation phase that becomes the exposure-starting phase P1 and ([Time T1 between exposure and transfer of one photosensitive body 28]−[Time T1 between exposure and transfer of the other photosensitive bodies 28]) is stored in advance in the storing means such as NVRAM 43, etc., and the actual exposure-starting phase P1 is determined based on the detection timing of the origin sensor 15 and the exposure-starting timing of the photosensitive body 28K. ([Time T1 between exposure and transfer of one photosensitive body 28]−[Time T1 between exposure and transfer of the other photosensitive bodies 28]) corresponding to the determined exposure-starting timing P1 is extracted from the information of corresponding relationship, and the difference ΔT' in exposure-starting time is calculated from the above-described expression 1.

Herein, such a configuration is included in the present invention, which, for example, information of the corresponding relationship between a rotation phase equivalent to 360 degrees with one-degree graduation and ([Time T1 between exposure and transfer of one photosensitive body 28]–[Time T1 between exposure and transfer of the other photosensitive bodies 28]) is stored in NVRAM 43, etc. However, the configuration requires a large memory capacity. Therefore, in the exemplary embodiment, as shown in FIG. 6, a phase equivalent to one cycle of the photosensitive body 28K is evenly divided into, for example, 8 sections, and a phase of one rotation in the corresponding respective division areas and varying parameters corresponding thereto with respect to each of the eight division areas are stored in the NVRAM 43, etc. In the exemplary embodiment, the phase of one rotation is the center rotation phase in the respective division areas. Actually, the phase of one rotation is stored in the NVRAM 43 as the number of encoder pulses from the origin detection timing. The [varying parameter] is correction time data equivalent to ([Time T1 between exposure and transfer of one photosensitive body 28]–[Time T1 between exposure and transfer of the other photosensitive bodies 28]) corresponding to the center the rotation phase. Also, the accumulated value of the varying parameter of one cycle T of the photosensitive body 28K becomes zero.

In addition, FIG. 6 shows only a varying parameter ([Time T1K between exposure and transfer of one photosensitive body 28K]–[Time T1Y between exposure and transfer of the photosensitive bodies 28Y]) to prevent a gap in the forming position of the lead lines of the black image and the yellow image. However, a varying parameter ([Time T1Y between exposure and transfer of one photosensitive body 28Y]–[Time T1M between exposure and transfer of the photosensitive body 28M]) to prevent a gap in the forming positions of the lead lines of the yellow image and magenta image and a varying parameter ([Time T1M between exposure and transfer of one photosensitive body 28M]–[Time T1C between exposure and transfer of the photosensitive body 28C]) to prevent a gap in the forming positions of the lead lines of magenta image and cyan image are associated with the respective division areas (center rotation phases) and stored. Further, FIG. 6 shows adjacent differences that are deviations in varying parameters between respective division areas adjacent to each other. However, the adjacent differences are not stored in the NVRAM 43, etc.

7. Process of Varying difference ΔT in Exposure-Starting Time

For example, if a user gives a printing command at the operation unit 46, the CPU 40 drives and rotates the gear mechanism of the entire printer 1 including the drive mechanism 33. Thereby, a single sheet 3 is conveyed from the feeder tray 4 to the registration roller 6, wherein the leading edge of the sheet 3 sent out by the registration roller 6 is detected by the registration sensor 17. The CPU 40 regards, as the exposure-starting timing of the photosensitive body 28K, the time arriving by the predetermined time T0 after the detection timing of the registration sensor 17, and at this time (that is, when the sheet 3 reaches the position D1 in FIG. 4), the lead line image of the black image is exposed to the photosensitive body 28K by the LED unit 18K.

Also, the CPU 40 cyclically recognizes the origin detection timing based on the detection signal SA from the origin sensor 15 (Refer to the middle stage in FIG. 4), and determines the exposure-starting phase P1 based on the origin detection timing and the exposure-starting timing of the photosensitive body 28K. Next, the CPU 40 selects a division area to which the determined exposure-starting phase P1 belongs, extracts varying parameters (T1K-T1Y, T1Y-T1M, T1M-T1C) corresponding to the selected division area from the information of the corresponding relationship in the NVRAM 43, etc., and obtains a regular difference ΔT' in exposure-starting time from the varying parameter and the expression 1 for each of the colors yellow, magenta and cyan. And, the time elapsed by the regular difference ΔT' in the exposure-starting time corresponding to yellow from the exposure-starting timing of the photosensitive body 28K is made into the exposure-starting timing of the photosensitive body 28Y. At this time (that is, when sheet 3 reaches the position D2 in FIG. 4), the lead line image of a yellow image is exposed to the photosensitive body 28Y by the LED unit 18Y. Therefore, it is possible to prevent the gap in the forming positions of the lead lines with respect to a black image and a yellow image.

Next, the time elapsed by a regular difference ΔT' in exposure-starting time corresponding to magenta from the exposure-starting timing of the photosensitive body 28Y is made into the exposure-starting timing of the photosensitive body 28M. At this time (that is, when sheet 3 reaches the position D3 in FIG. 4), the lead line image of a magenta image is exposed to the photosensitive body 28M by the LED unit 18M. Therefore, it is possible to prevent a gap in the forming positions of the lead lines of a yellow image and a magenta image. Hereinafter, this is the same for the photosensitive body 28C.

In addition, although the spacing between respective lines arriving after the lead lines of the respective color images varies due to fluctuations in the rotating speed of the photosensitive bodies 28, the CPU 40 carries out a process for correcting the line spacing so as to become equidistant. In detail, since time-series data of correction values of line spacing from the origin phase are stored in the NVRAM 43, etc., and the exposure timing of respective lines is corrected based on the time-series data, the line spacings can be made equidistant. And, the time-series data of line spacings are obtained from the fluctuation characteristics of the rotating speed of the respective photosensitive bodies 28 described above, which are acquired from the experiments shown in FIG. 5.

8. Advantages of the Exemplary Embodiment (1) According to the exemplary embodiment, if the exposure-starting phase P1 of an upstream one photosensitive body 28K is determined, the time T1K between exposure and transfer of the lead line for one photosensitive body 28K is determined based on the fluctuation characteristics of the rotating speed of the-one photosensitive body 28K. Further, the times T1Y, T1M and T1C of the lead lines for the other photosensitive bodies 28Y, 28M and 28C are determined based on the fluctuation characteristics of the rotating speeds of the other downstream photosensitive bodies 28Y, 28M and 28C. And, based on the times T1K, T1Y, T1M and T1C between exposure and transfer of the-one photosensitive body and the other photosensitive bodies and the moving time T3 of sheet 3, the regular difference ΔT' in exposure-starting time is determined so that it is possible to prevent a gap between the forming position of the lead line by the one-photosensitive body 28K and the forming position of the lead lines by the other photosensitive bodies 28Y, 28M and 28C on the sheet 3. Therefore, in the exemplary embodiment, the difference in exposure-starting time is varied according to the exposure-starting phase P1. With such a configuration, unevenness in the forming positions of the lead lines from the respective photosensitive bodies 28 can be prevented from occurring.

(2) According to the exemplary embodiment, since all the photosensitive bodies 28 are driven and rotated by a common drive motor 38, the cycles of one rotation of all the photosensitive bodies 28 are the same, and the phase relationship thereof is not changed for respective cycles. If the exposure-starting phase P1 of one photosensitive body 28K is determined, the times T1Y, T1M and T1C between exposure and transfer of the lead lines are unambiguously determined with respect to the other photosensitive bodies 28Y, 28M and 28C based on the fluctuation characteristics of the rotating speed of the other downstream photosensitive bodies 28Y, 28M and 28C. Therefore, it is possible to further securely prevent unevenness in the forming positions of the lead lines from the respective photosensitive bodies 28.

(3) Such a method for determining the exposure-starting timing of all the photosensitive bodies 28Y, 28M and 28C (downstream photosensitive bodies) as differences between exposure-starting time from the uppermost stream photosensitive body 28K is included in the present invention. However, the method requires individual calculation processes for modification of the exposure-starting timing of the respective downstream photosensitive bodies. On the contrary, according to the exemplary embodiment, since the exposure-starting timing of the respective downstream photosensitive bodies (28Y, 28M and 28C) is determined by using the exposure-starting timing of the upstream side photosensitive body (28K, 28Y, and 28M) closest thereto as a reference, it is possible to make the calculation process (Expression 1) common for modification the exposure-starting timing of the respective downstream photosensitive bodies.

(4) As has been made clear in the respective fluctuation characteristics graphs in FIG. 4, the rotating speeds of the respective photosensitive bodies 28 fluctuate in a sinusoidal waveform. Therefore, it is preferable that the rotation phase of one cycle is evenly divided by any power of 2 (for example, 2, 4, 8, 16, 32, . . . ). In the exemplary embodiment, the rotation phase is evenly divided into eight sections to define eight division areas.

Other Embodiments

The present invention is not limited to the above exemplary embodiment described with reference to the accompanying drawings. For example, the following embodiments may be included in the scope of the present invention.

(1) Although, in the above exemplary embodiment, the determining means is configured so that the exposure-starting phase P1 is determined based on the origin detection timing of the origin sensor 15 and the exposure-starting timing of the photosensitive body 28K, the determining means is not limited thereto. For example, such a configuration may be adopted, in which a rotary encoder is provided in the photosensitive body 28K, the rotation phase is monitored at all times, and the rotation phase in the exposure-starting timing of the photosensitive body 28K is determined as the exposure-starting phase P1. However, with the configuration of the above-described exemplary embodiment, the exposure-starting phase may be easily determined without requiring monitoring of the rotation phase of the photosensitive body 28K at all times.

(2) Although, in the above-described exemplary embodiment, all the division areas are the same area width (each 45 degrees), the division areas are not limited thereto. Among a plurality of division phase areas, a division phase area in which the fluctuation amount of the rotating speed of the photosensitive body 28 is large has a narrow area width, and a division phase area in which the fluctuation amount of the rotating speed of the photosensitive body 28 is small has a wide area width. For example, in FIG. 6 described above, the adjacent difference is maximized between the division area the rotation phase of which is 225 degrees through 270 degrees and the division area the rotation phase of which is 270 degrees through 415 degrees. Therefore, for example, as shown in FIG. 7, only the two division areas are divided into division areas having a further fine area width (for example, 22.5 degree each). According to the configuration, if the exposure-starting phase P1 is a rotation phase having a larger fluctuation amount in the rotating speed of the photosensitive body 28, varying parameters corresponding to a further fragmented division phase area are used. Therefore, it is possible to appropriately vary the difference in exposure-starting time according to the fluctuation characteristics of the rotating speed of the photosensitive body 28.

(3) In the above-described exemplary embodiment, the number of division areas for vary the difference in exposure-starting time is the same for all of the photosensitive bodies 28Y, 28M and 28C. However, generally, even if the forming position of the lead line of a yellow image deviates, the influence is slight in comparison with the other color images. Therefore, the number of division phase areas (for example, eight areas, refer to FIG. 6) corresponding to the photosensitive body 28Y to form a yellow image may be made smaller than the number of division areas (for example, 16 areas, refer to FIG. 8) corresponding to the photosensitive bodies 28M and 28C of a magenta image and a cyan image. With the configuration, it is possible to reduce the storing capacity of the storing means while improving the accuracy of varying the difference in exposure-starting time.

(4) Also, with respect to downstream photosensitive bodies 28 having large differences in the fluctuation characteristics of the rotating speed from the photosensitive body 28 (the photosensitive body 28K to the downstream photosensitive body 28Y, the photosensitive body 28Y to the downstream photosensitive body 28M, and the photosensitive body 28M to the downstream photosensitive body 28C) that becomes the reference of the exposure-starting timing of the downstream photosensitive bodies 28Y, 28M and 28C, such a configuration may be adopted, in which the number of division phase areas in the storing means is increased in comparison with the downstream photosensitive body 28 in which the corresponding difference is small. If such a configuration is adopted, varying parameters corresponding to fragmented division phase areas are utilized in the downstream photosensitive body having a larger difference in the fluctuation characteristics of rotating speed in connection to the photosensitive body 28 that becomes the reference of exposure-starting timing. Therefore, the difference in exposure-starting time can be appropriately varied according to the fluctuation characteristics of rotating speed of the photosensitive bodies 28.

(5) Although the above-described embodiment is provided with four photosensitive bodies 28, it is not limited thereto. Two or more photosensitive bodies may be adopted. Also, it may be acceptable that the present invention is not applied to all the photosensitive bodies but is applicable to some of the photosensitive bodies.

(6) In the above-described exemplary embodiment, the drive mechanism 33 is such that all the photosensitive bodies 28 are driven and rotated by a single drive motor 38. However, such a configuration may be adopted, in which photosensitive bodies 28 of a predetermined number are driven and rotated by an individual drive motor. However, in the configuration according to the above described exemplary embodiment, since all the photosensitive bodies 28 have almost the same cycle of one rotation, and the phase relationship thereof hardly changes, it is possible to further securely prevent unevenness in the forming positions of the lead lines from the respective photosensitive bodies 28.

(7) Although the above-described exemplary embodiment is configured so that varying parameters corresponding to the central rotation phase in the respective division areas are stored in the storing means, the embodiment is not limited thereto. The varying parameters may be those corresponding to, for example, the lead rotation phase or the last rotation phase of the respective division areas. However, if the configuration according to the above described exemplary embodiment is adopted, it is possible to prevent the variation accuracy in the difference in exposure-starting time from being biased by the determined exposure-starting phase P1.

(8) In the above-described exemplary embodiment, "recording medium" is sheet 3. The recording medium is not limited thereto. For example, where a test pattern for density correction is formed on the belt 13, the recording medium may become the belt 13 itself.

(9) Although, in the above-described exemplary embodiment, the rotation phase equivalent to one cycle of the photosensitive body 28 is divided into eight sections to form division areas, the rotation phase is not limited thereto. For example, phases equivalent to three cycles are divided into five sections. That is, such a configuration may be adopted, in which rotation phases equivalent to a plurality of cycles are divided into a plurality of divisions to form division areas.

(10) In the above-described exemplary embodiment, the exposing means is configured so as to have LEDs (light-emitting diodes). However, the exposing means is not limited thereto. The exposing means may be a number of EL (electro-luminescence) elements and light-emitting elements such as fluorescent bodies are arrayed, and the light-emitting elements are selectively caused to emit light according to image data, or a number of optical shutters consisting of liquid crystal elements and PLZTs are arrayed, and light from a light source is controlled by selectively controlling the opening and closing time of the optical shutters according to image data. Also, the exposing means may be another electro-photography system exposing means such as a laser system for exposure by means of laser beams.

(11) Differing from the above-described exemplary embodiment, the exposure-starting phase is not based on the rotation phase (the number of encoder pulses) but may be obtained as a difference in time between the origin detection timing and the exposure-starting timing. In this case, the column of division areas of information of the corresponding relationship will be defined as that obtained by dividing one or a plurality of cycles T of the photosensitive body 28, using the difference in time from the origin detection timing as a reference. Also, the central rotation phase of the information of the corresponding relationship becomes a difference in time until reaching the corresponding central rotation phase from the origin detection timing.

According to the exemplary embodiment: the image forming apparatus has: a plurality of photosensitive bodies arranged along the moving direction of a medium to be transferred; a drive mechanism for driving and rotating the plurality of photosensitive bodies; means for exposing the respective photosensitive bodies; means for determining an exposure-starting phase being a rotation phase at exposure-starting timing with respect to one photosensitive body among the plurality of photosensitive bodies; and means for varying a difference in the exposure-starting time between the exposure-starting timing of the-one photosensitive body and the exposure-starting timing of the other photosensitive bodies at the downstream side in the moving direction of the medium to be transferred, from the corresponding photosensitive body, according to the exposure-starting phase.

According to a first aspect of the exemplary embodiment, if the rotation phase at the exposure-starting timing of the upstream one photosensitive body (exposure-starting phase) is determined, the time between exposure and transfer of the lead line for the one photosensitive body (that is, the time required for the photosensitive body to rotate from the exposure position to the transfer position) is determined based on the fluctuation characteristics of the rotating speed of the-one photosensitive body. Further, the time between exposure and transfer of the lead lines for the other photosensitive bodies is determined based on the fluctuation characteristics of the rotating speed of the downstream other photosensitive bodies. And, the difference in the exposure-starting time (difference in time between the exposure-starting timing of the-one photosensitive body and the exposure-starting timing of the other photosensitive bodies) is determined based on the time between exposure and transfer of the-one photosensitive body and the other photosensitive bodies and the moving time required for the medium to move from the transfer position of the-one photosensitive body to the transfer position of the other photosensitive bodies, so that a gap between the forming position of the lead line of the-one photosensitive body and the forming position of the lead lines of the other photosensitive bodies can be prevented. Therefore, with the present invention, it was devised that the difference in exposure-starting time could be varied according to the exposure-starting phase. According to such a configuration, it is possible to prevent unevenness in the forming positions of the lead lines from the respective photosensitive bodies.

The second aspect of the exemplary embodiment is featured, in addition to the image forming apparatus according to the first aspect of the exemplary embodiment, in that the drive mechanism is configured so as to drive and rotate the-one photosensitive body and the other photosensitive bodies by means of a common drive source.

According to the exemplary embodiment, since a plurality of photosensitive bodies are driven and rotated by a common drive source, the plurality of photosensitive bodies have the same cycle for one rotation thereof, and the phase relationship thereof does not change. Therefore, if the exposure-starting phase of the upstream one photosensitive body is determined, the time between exposure and transfer of the lead lines of the other photosensitive bodies can be precisely obtained based on the fluctuation characteristics of the rotating speeds of the downstream other photosensitive bodies. Accordingly, it is possible to further securely prevent unevenness in the forming positions of the lead lines of the respective photosensitive bodies.

The third aspect of the exemplary embodiment is featured, in addition to the image forming apparatus according to the second aspect of the exemplary embodiment, in that the determining means includes a reference rotation phase sensor for detecting that the photosensitive body is brought into a reference rotation phase, and is configured so as to determine the exposure-starting phase based on the detection timing of the reference rotation phase sensor and the exposure-starting timing of the-one photosensitive body.

According to the exemplary embodiment, it is not necessary to monitor the rotation phase of the photosensitive bodies at all times, wherein the exposure-starting phase can be easily determined by detecting that the photosensitive bodies are brought into the reference rotation phase.

The fourth aspect of the exemplary embodiment is featured, in addition to the image forming apparatus according to the second or the third aspect of the exemplary embodiment, in that the plurality of photosensitive bodies are three or more photosensitive bodies, and the photosensitive body at an uppermost stream thereof is made into the-one photosensitive body, and the varying means is configured so as to vary the difference in exposure-starting time between the photosensitive bodies adjacent to each other according to the exposure-starting phase.

Such a method may be adopted, which determines all of the exposure-starting timings of two or more downstream photosensitive bodies excluding the uppermost stream photosensitive body as differences in the exposure-starting time from the uppermost stream photosensitive body. However, with the method, it becomes necessary to carry out individual calculation processes with respect to changes in the exposure-starting timing of the respective downstream photosensitive bodies. On the contrary, according to the present invention, since the exposure-starting timing of the respective downstream photosensitive bodies is determined using the exposure-starting timing of an upstream side photosensitive body closest thereto as a reference, it becomes possible that the calculation processes with respect to changes in the exposure-starting timings of the respective downstream photosensitive bodies can be made common.

The fifth aspect of the exemplary is featured, in addition to the image forming apparatus according to any one of the second aspect through the fourth aspect of the exemplary embodiment, in that it further includes storing means for storing varying parameters for varying the difference in exposure-starting time so as to prevent a gap between the forming position of the lead line by the-one photosensitive body and the forming position of the lead line of the other photosensitive bodies in one rotation phase in respective division areas for each of the division phase areas composed by dividing rotation phases equivalent to one or a plurality of circuits of the photosensitive body, wherein the varying means is configured so as to vary the difference in exposure-starting time based on variation parameters corresponding to a division phase area to which the exposure-starting phase belongs.

According to the exemplary embodiment, it is sufficient that variation parameters equivalent to the number of division areas are stored in the storing means, wherein it is possible to attempt to reduce the storing capacity.

The sixth aspect of the exemplary embodiment is featured, in addition to the image forming apparatus according to the fifth aspect of the exemplary embodiment thereof, in that the respective division phase areas are formed by evenly dividing a rotation phase equivalent to one circuit of the photosensitive body into any power of 2.

Since the fluctuation characteristics of the rotating speed equivalent to one circuit of a photosensitive body generally form sinusoidal waves, it is preferable that a rotation phase equivalent to one circuit is evenly divided into any power of 2 (for example, 2, 4, 8, 16, 32 . . . ).

The seventh aspect of the exemplary embodiment is featured, in addition to the image forming apparatus according to the fifth aspect of the exemplary embodiment, in that, among the plurality of the division phase areas, the area width is narrow in a division phase area where the fluctuation amount of the rotating speed of the photosensitive body is large, and the area width is wide in a division phase area where the fluctuation amount of the rotating speed of the photosensitive body is small.

According to the present invention, if the exposure-starting phase is a rotation phase in which the fluctuation amount of the rotating speed of a photosensitive body is larger, varying parameters corresponding to further fragmented division phase areas are utilized. Therefore, it is possible to appropriately vary the difference in the exposure-starting time according to the fluctuation characteristics of the rotating speed of photosensitive bodies.

The eighth aspect of the exemplary embodiment is featured, in addition to the image forming apparatus according to the fifth aspect or the seventh aspect of the exemplary embodiment, in that the plurality of photosensitive bodies are three or more photosensitive bodies forming a yellow image and other color images, respectively, and two or more downstream photosensitive bodies excluding the uppermost stream photosensitive body are made into the other photosensitive bodies; and the photosensitive body forming the corresponding yellow image has a small number of the division phase areas in the storing means than the photosensitive bodies forming the other colors.

Generally, even if the forming position of the lead line deviates in a yellow image, the influence is slight in comparison with the other color images. Therefore, it is attempted that the storing capacity of the storing means is reduced by reducing the number of division phase areas corresponding to the photosensitive body that forms the yellow image.

The ninth aspect of the exemplary embodiment is featured, in addition to the image forming apparatus according to any one of the fifth aspect through the seventh aspect of the exemplary embodiment, in that the plurality of photosensitive bodies are three or more photosensitive bodies, and two or more downstream photosensitive bodies excluding the uppermost stream photosensitive body are made into the other photosensitive bodies, and downstream photosensitive bodies having a large difference in fluctuation characteristics in the rotating speed with respect to the photosensitive body in which the reference of the exposure-starting timing is established have a larger number of the division phase areas in the storing means than the downstream photosensitive bodies for which the corresponding difference is slight.

According to the exemplary embodiment, since downstream photosensitive bodies having a greater difference in the fluctuation characteristics of the rotating speed with respect to the photosensitive body that becomes the reference of the exposure-starting timing utilizes varying parameters corresponding to fragmented division phase areas, it is possible to appropriately vary the differences in the exposure-starting time according to the fluctuation characteristics of the rotating speed of photosensitive bodies.

What is claimed is:

1. An image forming apparatus, comprising:

a plurality of photosensitive bodies disposed along a moving direction of a recording medium;

a drive mechanism for driving and rotating the plurality of photosensitive bodies;

a plurality of exposure units, each exposure unit being associated with a respective one of the photosensitive bodies, the each exposure unit configured to expose the respective photosensitive body;

a determining unit for determining an exposure-starting phase that is a rotation phase at an exposure-starting timing with respect to one photosensitive body among the plurality of photosensitive bodies; and a varying unit for varying an exposure-starting time difference between the exposure-starting timing of the one photosensitive body and an exposure-starting timing of another photosensitive body disposed at a downstream side of the one photosensitive body in the moving direction of the recording medium, based on the exposure-starting phase.

2. The image forming apparatus according to claim 1, wherein the drive mechanism includes a common drive source for driving and rotating the one photosensitive body and the other photosensitive body.

3. The image forming apparatus according to claim 2, wherein the determining unit includes a reference rotation phase sensor for detecting that the photosensitive body is brought into a reference rotation phase, and the determining unit determines the exposure-starting phase based on a detection timing of the reference rotation phase sensor and the exposure-starting timing of the one photosensitive body.

4. The image forming apparatus according to claim 2, wherein the plurality of photosensitive bodies are three or more photosensitive bodies, and the one photosensitive body is the photosensitive body that is disposed at an uppermost stream side in the moving direction of the recording medium, and wherein the varying unit is configured to vary the exposure-starting time difference between the photosensitive bodies adjacent to each other based on the exposure-starting phase.

5. The image forming apparatus according to claim 2, further comprising:

a storing unit for storing a parameter for varying the exposure-starting time difference, the parameter being used for preventing a gap between a position of a lead line formed by the one photosensitive body and a position of a lead line formed by the other photosensitive body in one rotation phase of division phase areas, the division phase areas composed by dividing a rotation phase equivalent to one circuit or a plurality of circuits of the photosensitive body, the storing unit storing the parameter for each of the respective division phase areas, wherein the varying unit is configured to vary the exposure-starting time difference based on the parameter corresponding to a division phase area to which the exposure-starting phase belongs.

6. The image forming apparatus according to claim 5, wherein the respective division phase areas are formed by evenly dividing the rotation phase equivalent to one circuit of the photosensitive body into a power of 2.

7. The image forming apparatus according to claim 5, wherein among the plurality of division phase areas, an area width is narrow in a division phase area where a fluctuation amount of the rotating speed of the photosensitive body is large, and an area width is wide in a division phase area where the fluctuation amount of the rotating speed of the photosensitive body is small.

8. The image forming apparatus according to claim 5, wherein the plurality of photosensitive bodies are three or more photosensitive bodies forming a yellow image and other color images, respectively, and two or more downstream photosensitive bodies excluding an uppermost stream photosensitive body are the other photosensitive bodies; and the photosensitive body forming the yellow image has a less number of division phase areas in the storing unit than the photosensitive bodies forming the other colors.

9. The image forming apparatus according to claim 5, wherein the plurality of photosensitive bodies are three or more photosensitive bodies, and two or more downstream photosensitive bodies excluding an uppermost stream photosensitive body are the other photosensitive bodies; and the downstream photosensitive body having a large difference in fluctuation characteristics in rotating speed with respect to the photosensitive body in which a reference of the exposure-starting timing is established has a larger number of the division phase areas in the storing unit than the downstream photosensitive body in which the difference in fluctuation characteristics is slight.

10. An image forming apparatus, comprising:

a plurality of photosensitive bodies disposed along a moving direction of a recording medium;

a drive mechanism configured to drive and rotate the plurality of photosensitive bodies;

a plurality of exposure units, each exposure unit being associated with a respective one of the photosensitive bodies, and being configured to expose the respective photosensitive body; and a control device configured to:

determine an exposure-starting phase that is a rotation phase at an exposure-starting timing with respect to one photosensitive body among the plurality of photosensitive bodies, and vary an exposure-starting time difference between the exposure-starting timing of the one photosensitive body and an exposure-starting timing of another photosensitive body disposed at a downstream side of the one photosensitive body in the moving direction of the recording medium, based on the exposure-starting phase.

* * * * *